US007491886B2

(12) United States Patent
Fazakas

(10) Patent No.: US 7,491,886 B2
(45) Date of Patent: Feb. 17, 2009

(54) CURRENT CONDUCTOR MADE OF BRAIDED WIRE

(76) Inventor: András Fazakas, Benczúr u. 39/b. V. em., Budapest (HU) H-1068

( * ) Notice: Subject to any disclaimer, the term of this patent is extended or adjusted under 35 U.S.C. 154(b) by 136 days.

(21) Appl. No.: 10/589,571

(22) PCT Filed: Feb. 16, 2005

(86) PCT No.: PCT/HU2005/000014

§ 371 (c)(1),
(2), (4) Date: Aug. 16, 2006

(87) PCT Pub. No.: WO2005/078744

PCT Pub. Date: Aug. 25, 2005

(65) Prior Publication Data

US 2007/0199730 A1 Aug. 30, 2007

(30) Foreign Application Priority Data

Feb. 16, 2004 (HU) ..... 0400422

(51) Int. Cl.
*H01B 7/18* (2006.01)

(52) U.S. Cl. ..... 174/102 R; 174/108; 174/109

(58) Field of Classification Search ..... 174/102 R, 174/106 R, 107, 108, 109, 110 R, 110 F, 174/110 FC See application file for complete search history.

(56) References Cited

U.S. PATENT DOCUMENTS

| | | | | |
|---|---|---|---|---|
| 4,719,320 | A * | 1/1988 | Strait, Jr. | 174/106 R |
| 6,824,553 | B1 * | 11/2004 | Samson et al. | 606/192 |
| 2002/0009273 | A1 | 1/2002 | Akasaka et al. | |

FOREIGN PATENT DOCUMENTS

| | | | |
|---|---|---|---|
| DE | 201 01 054 | U1 * | 5/2001 |
| GB | 2 258 940 | A | 2/1993 |
| GB | 2 323 207 | A | 9/1998 |

* cited by examiner

*Primary Examiner*—William H Mayo, III
(74) *Attorney, Agent, or Firm*—Fitch, Even, Tabin & Flannery; Norman N. Kunitz

(57) ABSTRACT

A current conductor made of braided wire is provided for use in applications of over 5 A/mm$^2$ density or in pulsating applications. The current conductor is formed by braiding conductor-containing groups (11) of strands that are insulated from one another, with the groups (11*a*, 11*b*) intersecting one another at an angle. The braid has a cross section of closed profile, and within the cross section a spacer (12)is positioned for preserving the shape of the profile and for maintaining spaced the braid portions facing one another. The angle of intersection of the mutually intersecting groups (11) is 90°±30°.

8 Claims, 1 Drawing Sheet

CURRENT CONDUCTOR MADE OF BRAIDED WIRE

CROSS REFERENCE TO RELATED APPLICATION

Figure 1:
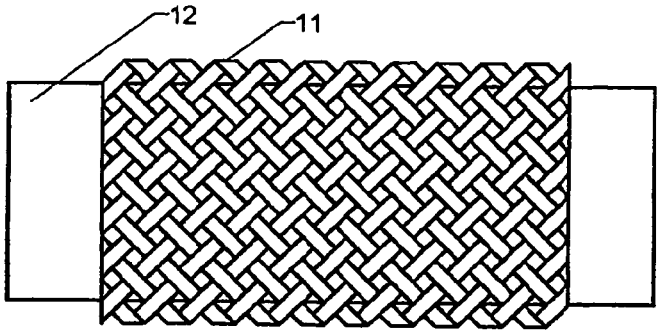

This application is the National Stage filing under 35 U.S.C. 371 of International Application No. PCT/HU2005/000014, filed Feb. 16, 2006, and claims the priority of Hungarian patent application No. P0400422, filed Feb. 16, 2004, the subject matter of which is incorporated, in their entireties, by reference. cl BACKGROUND OF THE INVENTION The invention relates to a current conductor, which is made of braided wire and which is intended particularly for use with high-density currents.

By braided wires a braided structure of a closed-profile cross section is meant which is made by braiding wire groups each formed of a plurality of thin conductor strands (elemental wires) or only of a single strand and in which the wire groups cross one another at a given angle. The original cross section of the braided wires is in most cases circular or in some instances oval. By applying a force perpendicularly to the original cross section, often products of flat or rectangular cross section are manufactured. Manufacturing technologies are known with which multi-layer, flat, braided products may be made.

In the conventional braided wires the individual strands are not insulated from one another, and the strands are in mutual contact along a very substantial area. Braided wires are classified in accordance with the material and surface coating of the elemental strands, the cross-sectional shape (circular, oval or flat) and, within each such class, in accordance with size. Classification by size includes shape-characterizing data (for example, diameter or width and height), the quantity of individual strands in the groups, the quantity of groups and the length-wise measured distance between the points of intersection of oppositely oriented groups. Further derived characteristics are the full cross-sectional area, the electric resistance per unit length, the weight and, in given cases, the permissible current density.

Braided wires also form the shielding sheaths of shielded cables. Wires intended as shields are generally not used for conducting large currents; the dimension and number of the individual strands are determined only based on requirements concerning the necessary mechanical strength and the quality of shielding.

In another practical application braided wires form the outer, holding layer of large-current conducting cables made of twisted or braided wires. The primary purpose of such a braided-wire layer is to ensure a mechanical cohesion, rather than to conduct current.

Braided wires used exclusively for conducting high-density currents find application only in an environment where a flexibility of the wires is also required. A typical application in this connection is the coupling of the carbon brushes of electric motors. For such a purpose braided wires of flat cross-sectional shape are used to ensure an increased flexibility.

Numerous other applications of braided wires are known, such as speaker cables, where the high transfer frequency and low loss are primary considerations, while a maximum permissible current density associated with a given heat-up is not a required condition. Another example is the provision of flexible couplings in medical instruments, where taking advantage of a maximum current density has also no significance.

Numerous information on braided wires may be found on the internet, particularly on the home pages of major manufacturing companies. Addresses of typical examples are www.newenglandwire.com/braidedwire.html or www.leoni-.com.

One of the recent uses of precious metal braids may be found in the fashion world where jewelry and its components are made by braiding technology.

In electrical installations, particularly in case of large-current control systems, the main circuits of the controlled installations may carry large currents (in a range of 10 A to 10,000 A), for which conductors of low inner resistance and thus low loss are needed. The large currents often occur as pulsing currents, having steep ascending and descending slopes. For a shape-true (distortion-free) transmission of such currents conductors are needed, whose resistance is suitably low even in a high-frequency range.

Inside battery chargers, power converters and other power current devices where a flexibility of the connection between two points is not a requirement, generally bus bars are used for conducting large currents. In case of bus bars, connections may be obtained only at defined transient resistances, and further, because of the practically mandatory perpendicular conductor configurations, the length of the bus bars is greater than the distance between the two points to be connected. This circumstance increases the dimension of the device and further, it involves ohmic losses that are greater than necessary.

The permissible current density of conventional wires designed for conducting large currents is determined by numerous factors. In view of the fact that a release of the generated heat may occur only through the surface, and the surface per given length unit is proportionate to the diameter, and further, the generated heat loss is proportionate to the cross section, which, in turn, is a function of the diameter squared, the permissible current density decreases as the cross section increases.

Given a certain cross section, the permissible current density may be determined, for example, for a given external temperature and a given temperature increase of the conductor relative to the environment. According to a known table of permissible current densities relating to twisted copper conductors, also provided with a braided outer layer under given circumstances, at 35° C. outer temperature and 70° C. conductor temperature, the permissible current density in case of a cross section of 2.5mm$^2$ is 12 A/mm$^2$ and in case of a cross section of 50 mm$^2$ the permissible current density is only 5 A/mm$^2$.

It is an object of the invention to provide a current conductor which under comparable heat-up and identical cross sections may handle significantly (advantageously at least 50%) larger currents than conventional current conductors.

It is a further object of the invention to also provide for a flexibility of the current conductor, that is, to ensure that it is positionable along the shortest path between two points and to further ensure that the loss-related resistance remains acceptably low up to relatively high frequencies.

SUMMARY OF THE INVENTION

The invention is based on the recognition or assumption that in solid or braided conductors or in braided conductors of flat cross section the elemental parallel or nearly parallel current paths result in mutual effects that increase losses, since current will flow effectively only in one part of the available cross section.

In case the above-stated assumption is correct, then in suitably structured braided wires the wire groups or a single wire replacing a wire group, have to be guided in such a manner that the strands belonging to different groups should intersect one another only at an angle, expediently at an angle of 90° or deviating therefrom by ±30° at the most, and should otherwise be positioned spaced from one another.

According to a solution of ensuring a spaced positioning, it is advantageous to provide an insert inside the braided wire for distancing the facing surfaces of the wires from one another. The insert may expediently be of circular or elliptical cross section.

From the point of view of current conduction it is advantageous to insulate the elemental strands of the groups from one another, for this purpose the strands are provided with a suitable insulating coating, advantageously with a conventional enamel insulation.

In case of significant current densities and cross sections the spacer insert may be a tube through which a coolant liquid may be passed. In such a case the wall of the insert should be appropriately thin and expediently have heat conducting properties.

It has been found that the braided wire structured according to the invention is capable of conducting a current of significantly greater density than the best conventional braided wire having the same material and cross section and further, it does not distort the steep signals appearing during a pulsing control, and does not cause appreciable, frequency-dependent losses.

The invention will be explained below in more detail by describing exemplary embodiments in conjunction with the drawing, where

BRIEFF DESCRIPTION OF THE DRAWINGS

Figure 2:
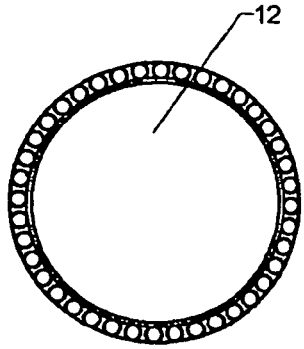
Figure 3:
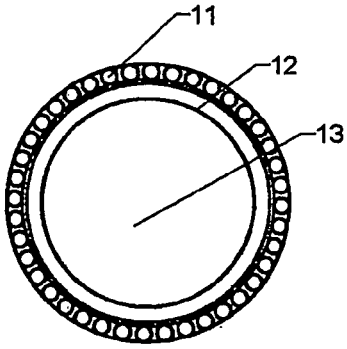
Figure 4:
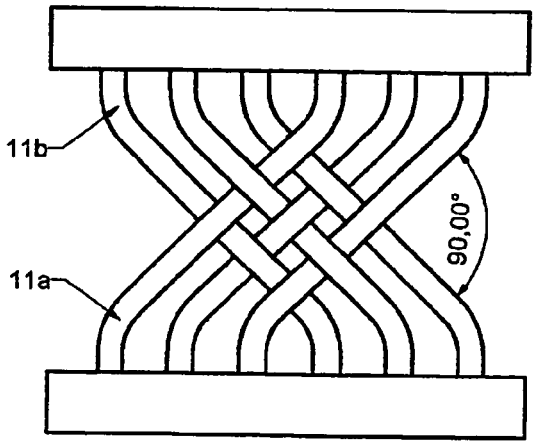

FIG. 1 is a simplified front elevational view of a current conductor made of braided wire according to the invention, FIG. 2 is a side elevational view of the current conductor shown in FIG. 1, FIG. 3 is a side elevational view of an alternative embodiment, and FIG. 4 is an enlarged and developed view of a detail of the braid.

DETAILED DESCRIPTION OF THE INVENTION

The braid of the braided wire 10 shown in FIGS. 1-3 consists of groups 11 intersecting one another at 90° and formed of enameled or otherwise insulated parallel, elemental copper strands. The individual groups of the braided wire 10 may each consist of a single conductor as depicted in the drawing. The braided wire 10 has a circular cross section. As shown in FIG. 2, the cross-sectional area is filled by a spacer 12, which may be an extruded material, foamed polyethylene, tetrafluoroethylene or any flexible material conventionally used in the cable or wire manufacture. Advantageously, as shown in FIG. 3, the spacer 12 is hollow; its cavity 13 is adapted to conduct a coolant liquid. Such a solution is called for only in case of significant dimensions.

FIG. 4 shows a detail of the braid of the braided wire 10. The groups 11*a* and 11*b* of the braid intersect one another at 90°. The groups 11*a* and 11*b* each consist of a single conductor strand.

In view of the fact that, as far as the current flowing through the braided wire 10 is concerned, the structure of the inside of the spacer 12 only affects, at the most, the cooling conditions, in conductors of less significant diameter, that is, less than 20 $mm^2$, the inside of the spacer 12 may accommodate single-lead or multi-lead conductors. These conductors may handle weak-current signals whose travel does not give rise to a heat generation which is comparable to the loss-related heat appearing in the braided wire 10.

In a practical realization of the structure shown in FIG. 1, the outer diameter was dimensioned at 3 mm and the elemental strands were insulation-free copper wires, from which ten groups of 0.25 $mm^2$ cross section each were formed. Thus, the braided wire 10 of the example had a total diameter of 2.5 $mm^2$. The spacer 12 was foamed polyethylene. A current of 50 A was passed through the braided wire 10 at an outer temperature of 35° C. The temperature of the braided wire 10 was measured and it was found that its stabilized temperature was only by +3° C. higher. Thus, the current density belonging to the temperature increase of +3° C. was 20 $A/mm^2$, which is substantially greater (by 66%) than in case of the usual 30 A current belonging to the same cross section. The temperature increase, however, was not 35° C., but only less than one tenth thereof.

In another experiment, the main current circuit of a pulsing battery charger was made of the braided wire 10 according to the invention. The shape of the pulses was observed by a multi-ray oscilloscope at the terminal of the battery of 60 Ah capacity, and at the output of the control circuit operating the charging process. The two observed points were connected by a 0.5 m long braided wire 10 described in the example. By superposing the two signals, a shape-deviation could not be found even at the steepest portion. The braided wire 10 did not heat up appreciably; that is, the extent of heat-up fell into the earlier-noted 3° C. range. In contrast, when the braided wire 10 was replaced by a conventional twisted wire of the same diameter, the wire heated up and a visible deviation could be observed between the two signal shapes along their ascending portion.

The solution according to the invention appears to verify the above-noted original assumption. The extremely significant current density increase may open new horizons in the construction of power-current devices. Such horizons manifest themselves in the reduction of dimension and losses, the simplicity of assembly, as well as the increase in the signal shape fidelity of control. The braided wire according to the invention may be manufactured at a cost comparable to that of conventional wires; further, the braiding technology is well known and well equipped, and, at the same time, the smaller wire quantity usable for the same purpose means a significant saving of material.

The invention claimed is:

1. A current conductor made of braided wire and formed of braided groups of wire strands intersecting one another at an angle, wherein the angle of intersection between the groups intersecting one another is 90 °±30°, the braid has a closed cross-sectional profile, and a spacer insert is positioned within the cross section for preserving the shape of the profile, wherein the current conductor is used for current densities exceeding 5 $A/mm^2$ and the strands in each group are insulated from one another, and said braided groups of wire continuously covering the outer surface of said spacer insert.

2. The current conductor as defined in claim 1, wherein each group contains a single strand.

3. The current conductor as defined in claim 1, wherein each group contains a plurality of parallel, elemental strands.

4. The current conductor as defined in claim 3, wherein the strands carry an enamel insulation.

5. The current conductor as defined in claim 1, wherein the spacer insert has a circular or elliptical cross section.

6. The current conductor as defined in claim 1, wherein the spacer insert is a tube having an inner cavity.

7. The current conductor as defined in claim 1, wherein a coolant liquid may be passed through the inner cavity of the spacer insert.

8. The current conductor as defined in claim 1, wherein in the inner cavity of the spacer insert, an additional conductor or an additional wire is positioned.

* * * * *